United States Patent [19]

Schwippert et al.

[11] 4,050,562

[45] Sept. 27, 1977

[54] BANKNOTE ESCROW AND STACKER APPARATUS AND METHOD

[75] Inventors: Guustaaf Arthur Schwippert, Pijnacker; Wilhelm Aart Van Zeggeren, Bleiswijk, both of Netherlands

[73] Assignee: Mars, Inc., McLean, Va.

[21] Appl. No.: 665,914

[22] Filed: Mar. 11, 1976

Related U.S. Application Data

[63] Continuation-in-part of Ser. No. 569,155, April 18, 1975.

[30] Foreign Application Priority Data

Apr. 22, 1974 United Kingdom ..... 17551/74

[51] Int. Cl.[2] ..... G07F 1/06

[52] U.S. Cl. ..... 194/4 E; 214/6 DK; 271/180

[58] Field of Search ..... 271/177–181, 271/189–192, 218; 214/6 DK; 194/DIG. 9, 4 E, DIG. 26

[56] References Cited

U.S. PATENT DOCUMENTS

| | | | |
|---|---|---|---|
| 3,655,186 | 4/1972 | Bayha | 271/180 |
| 3,683,758 | 8/1972 | Feldkamper | 214/6 D |
| 3,782,543 | 1/1974 | Martelli | 209/DIG. 1 |
| 3,851,744 | 12/1974 | Erickson | 194/DIG. 26 |

*Primary Examiner*—Allen N. Knowles

*Attorney, Agent, or Firm*—Davis, Hoxie, Faithfull & Hapgood

[57] ABSTRACT

A currency handling machine receives a banknote and transports it in tension to an escrow container for temporary storage in a stack along with any other banknotes involved in a transaction until the customer instructs the machine to either complete the transaction or to cancel the transaction and return his money. The banknote or stack of banknotes is conveyed to a locked deposit box if the transaction is completed or is conveyed within the escrow container to a refund compartment accessible by the customer if the transaction is cancelled.

45 Claims, 16 Drawing Figures

BANKNOTE ESCROW AND STACKER APPARATUS AND METHOD

Figure 1:
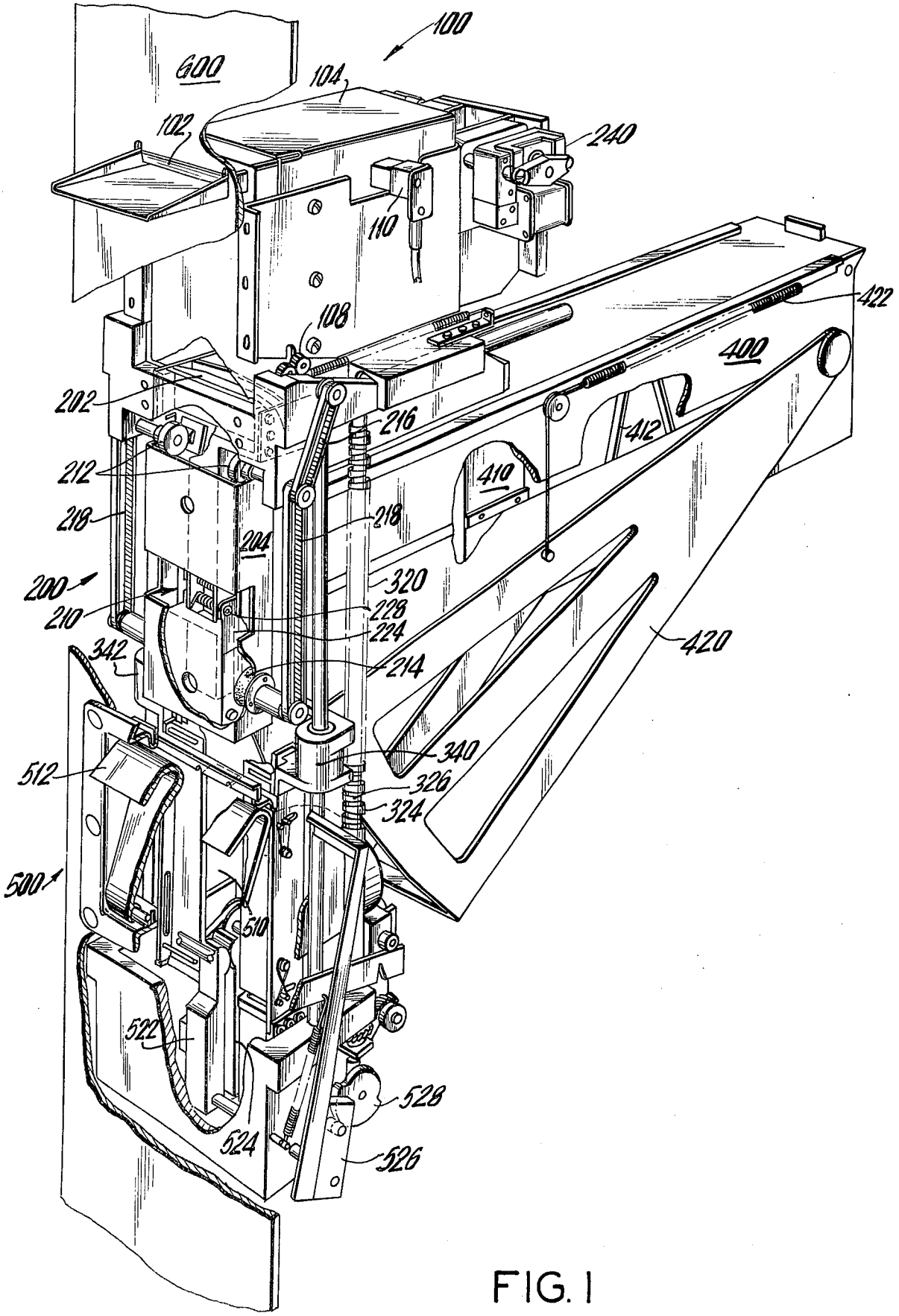

This application is a continuation-in-part of Ser. No. 569,155, filed Apr. 18, 1975.

The present invention is concerned with a machine which handles paper currency such as banknotes and the like for use in connection with machines which vend goods, tickets, tokens, make change, control and admission gate, or provide other machine performable transactions. In particular, the present invention is concerned with the apparatus for receiving and storing banknotes in stacks including escrow means which temporarily retain banknotes inserted by the customer until the machine is instructed by the customer to either complete or cancel a transaction. Upon an instruction to complete the transaction, the machine transfers the banknotes into a deposit container and causes the generation of an electrical vend signal to effect dispensing of the selected product, service or other subject of the transaction. Upon instruction to cancel the transaction, the escrow means returns the inserted banknotes.

The present invention operates in conjunction with a conventional banknote validator mechanism which receives a banknote from the customer, verifies that the banknote is a genuine, acceptable banknote of the proper denomination, provides an electrical signal indicating that the banknote is acceptable. The present invention transports the banknote edgewise to a banknote receiving zone, hereafter called the "pre-storage" location or compartment. The banknote is then moved facially from the pre-storage compartment to an accumulator compartment, hereafter called the "escrow" compartment or container. If more than one banknote is involved in the same transaction, the subsequent banknotes are accumulated in the escrow compartment. When banknotes sufficient in value for the transaction have been validated and accumulated in the escrow compartment, the customer can instruct the machine to vend or a prior vend instruction can take effect. The machine then generates a vend signal which causes vending of the selected goods or services. At this time the stack of banknotes are further facially moved from the escrow compartment into a deposit box or container in which banknotes are stored until they are collected from the machine. At any time prior to a vend instruction while one or more banknotes are temporarily stored in the escrow compartment, the customer can instruct the machine to cancel the transaction and return his money. Upon receipt of a cancel instruction, the escrow compartment containing the stack of banknotes is moved downwardly by means of an elevator mechanism. The stack of banknotes is extracted from the compartment which returns upwardly to its normal position. The extracted banknotes are retained in a refund compartment to which the customer has access. This refund capability is important to increasing consumer acceptance of automatic transaction machinery since the customer does not lose control over his money until he decides that the transaction should be completed.

The desirability of escrow means in a banknote receiving apparatus is well known. For example, U.S. Pat. No. 3,783,989 describes a single banknote escrow which permits retrieval of an inserted banknote if the transaction is not completed and U.S. Pat. No. 3,108,680 describes an escrow which receives and returns banknotes seriatum. U.S. Pat. No. 3,851,744 describes one type of stacked banknote escrow means. The escrow and return means of the present invention gathers inserted banknotes in a single stack, offering greater speed of operation and improved reliability in refunding banknotes by transporting the escrow means containing the banknotes in a stack to the refund means.

Throughout this specification and the claims, where reference is made to a "banknote" or "banknotes", the reference is intended to include all types of paper currency and the like. Similarly, where reference is made to the "face" of a banknote or banknotes, the reference is intended to include either major surface.

Figure 2:
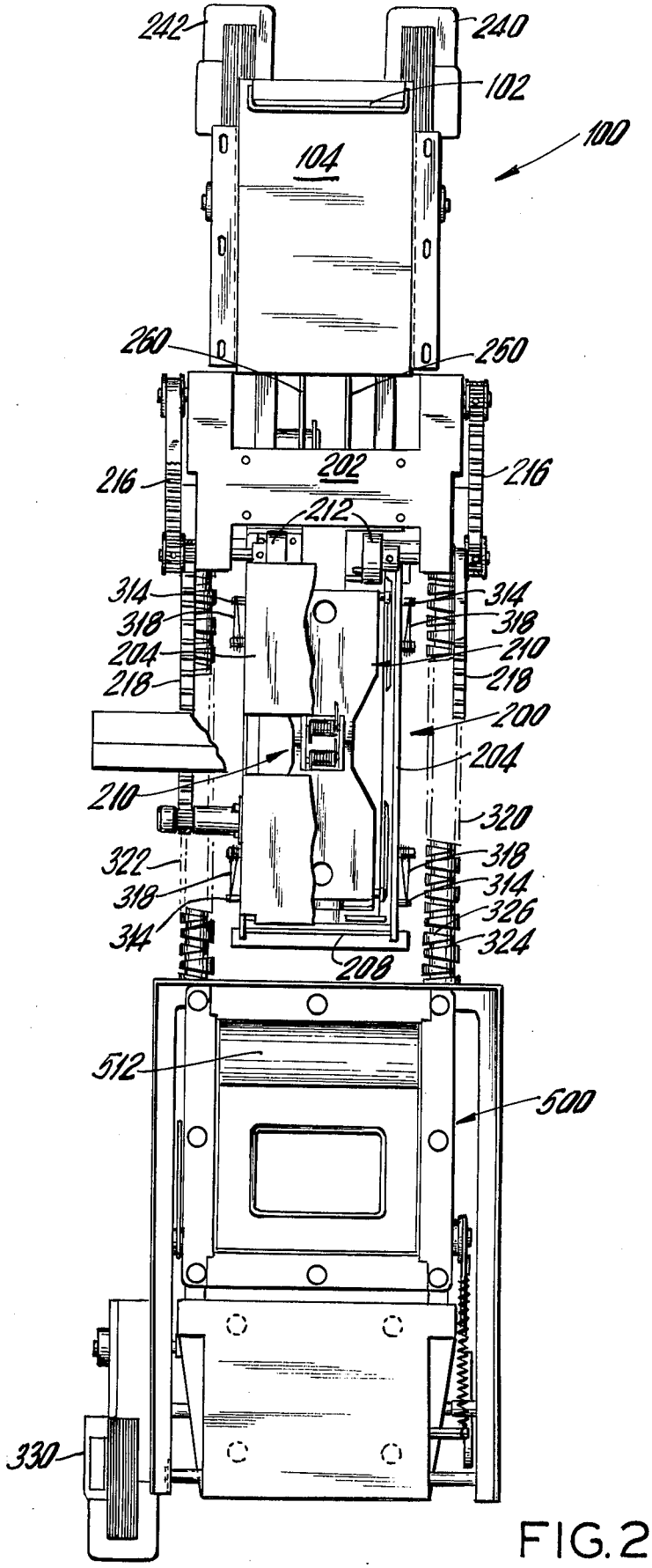
Figure 3:
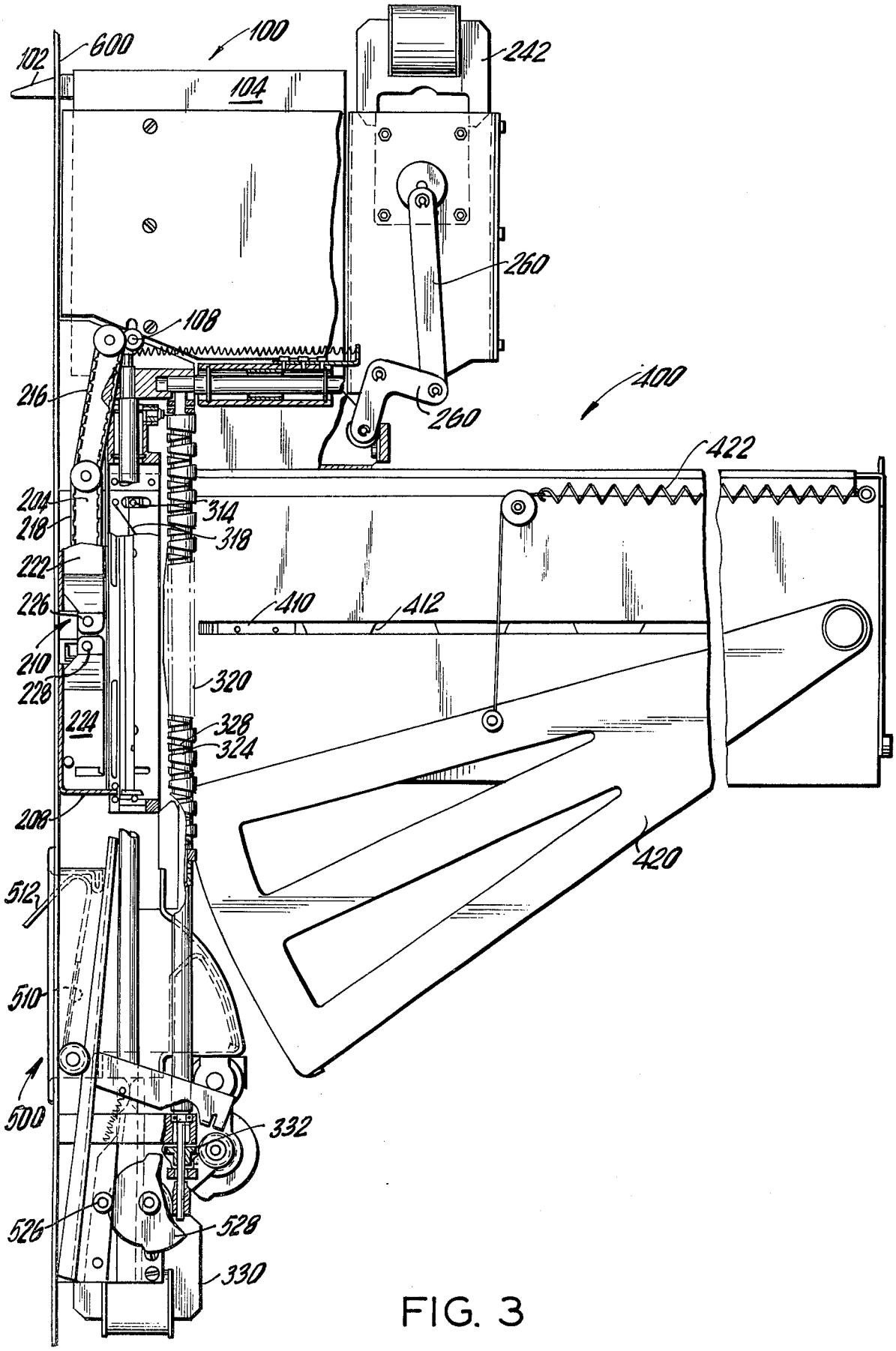
Figure 4:
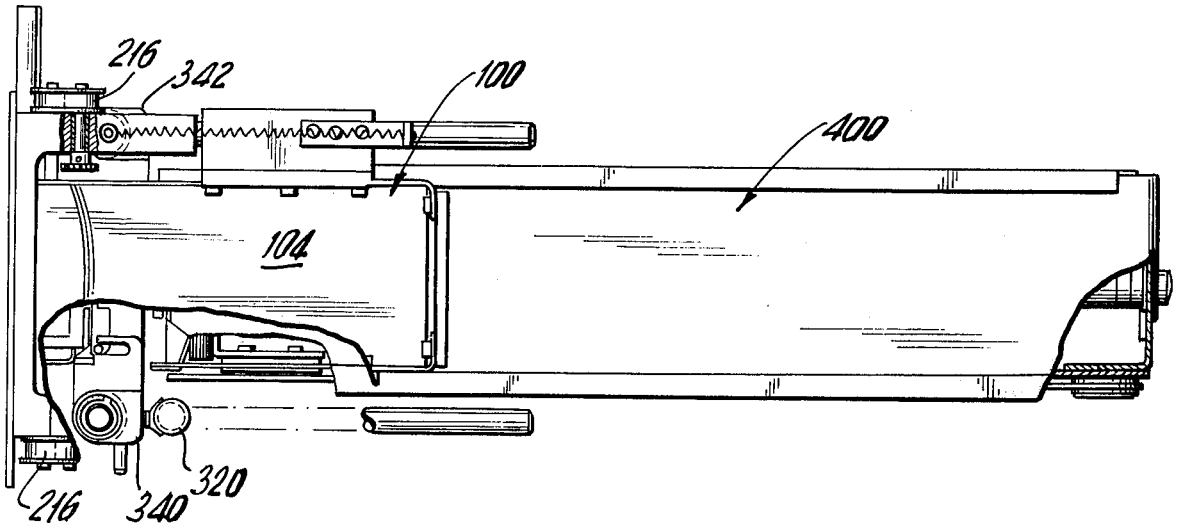
Figure 5:
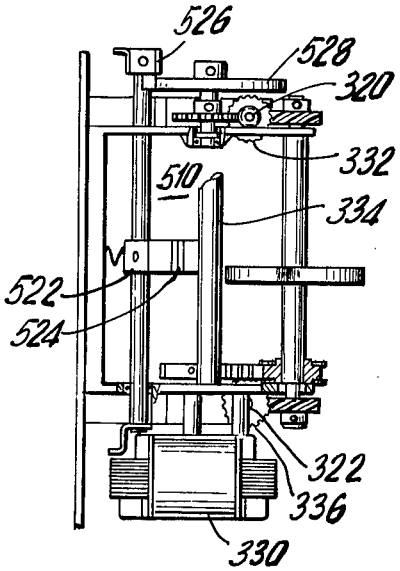
Figure 6:
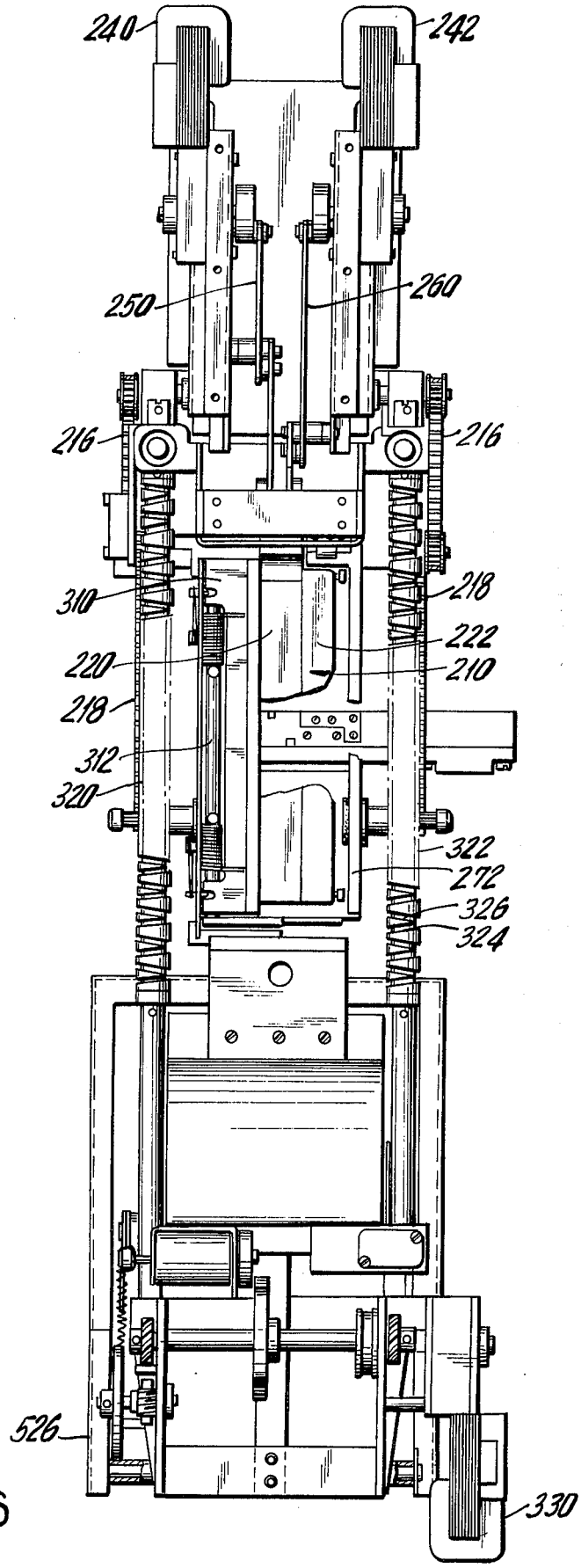
Figure 7:
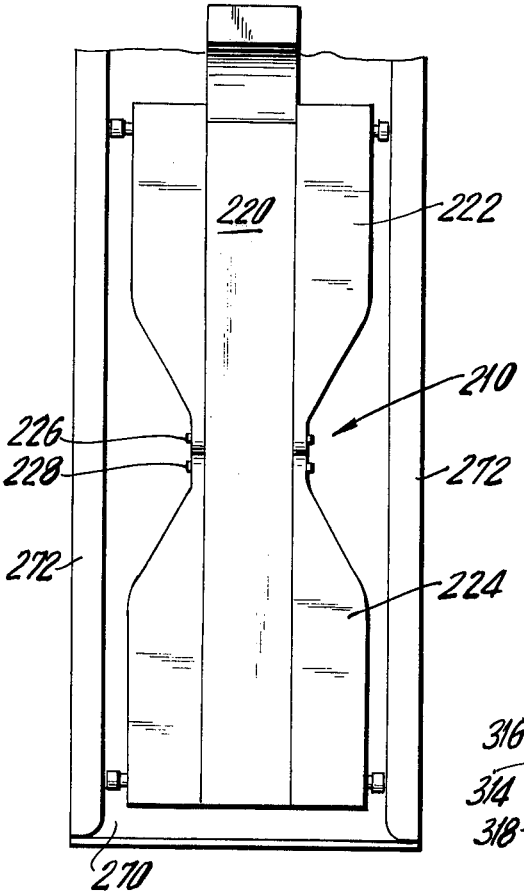
Figure 8:
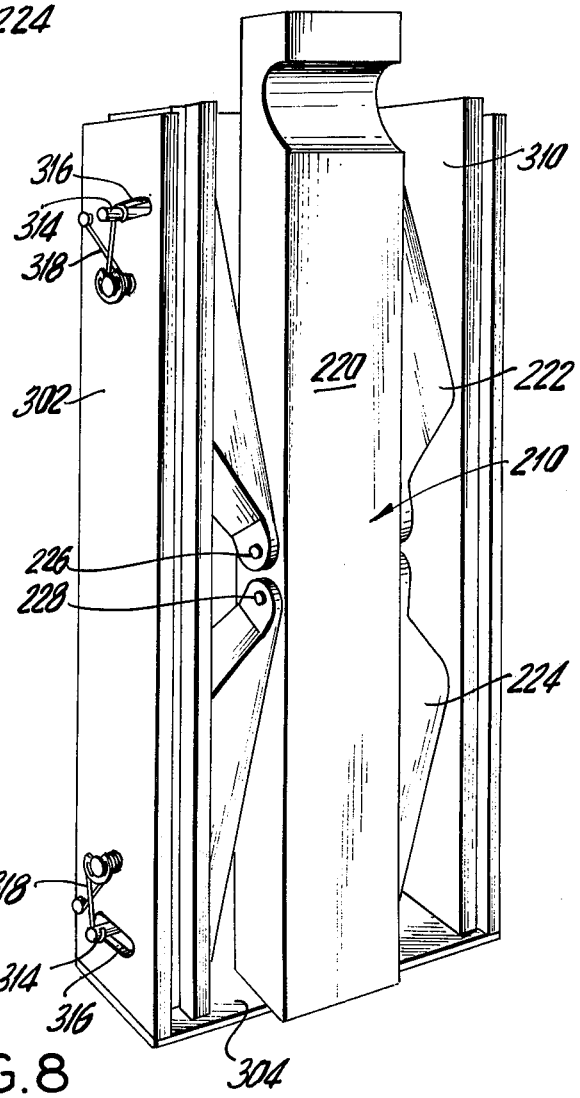
Figure 9A:
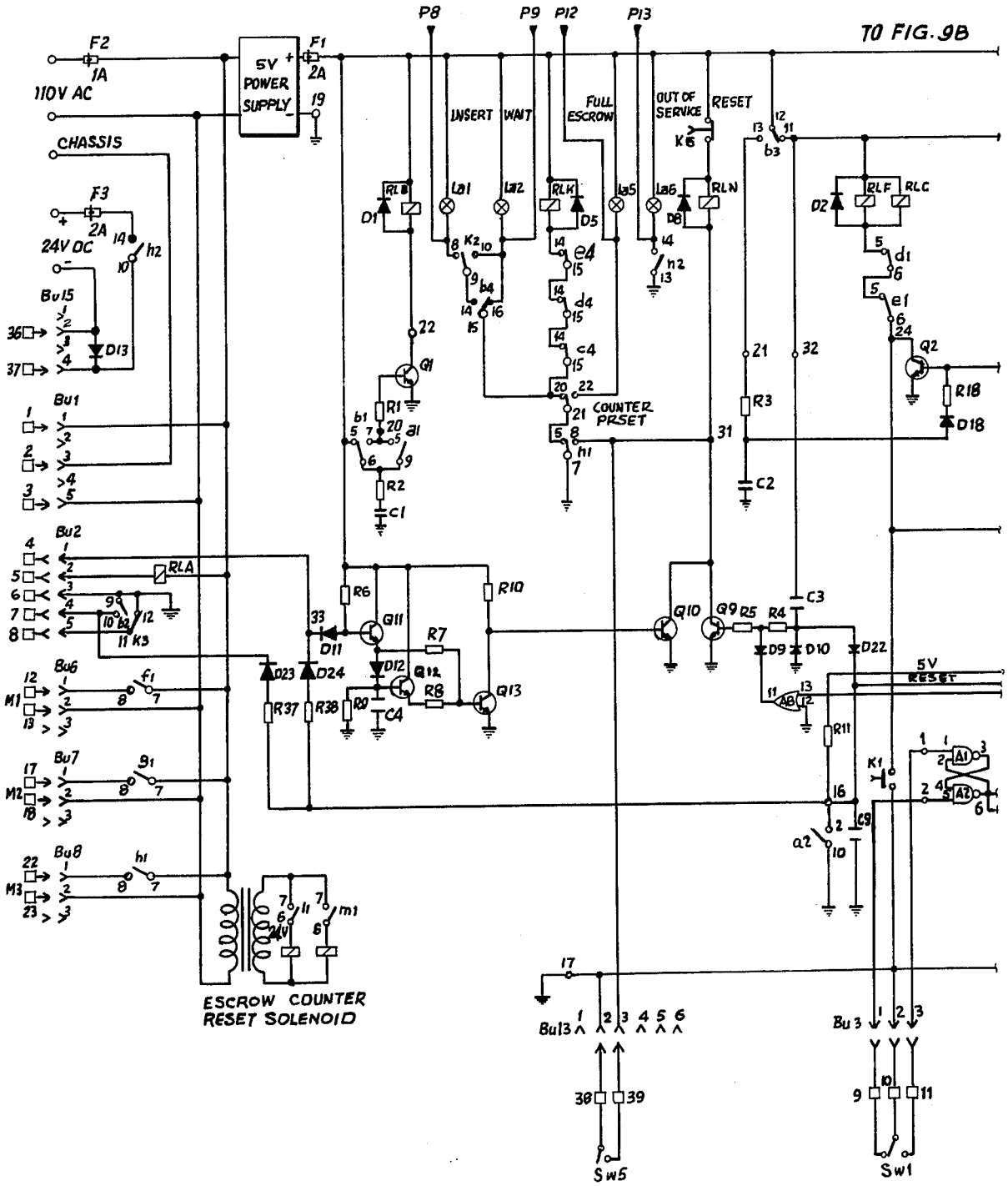
Figure 9B:
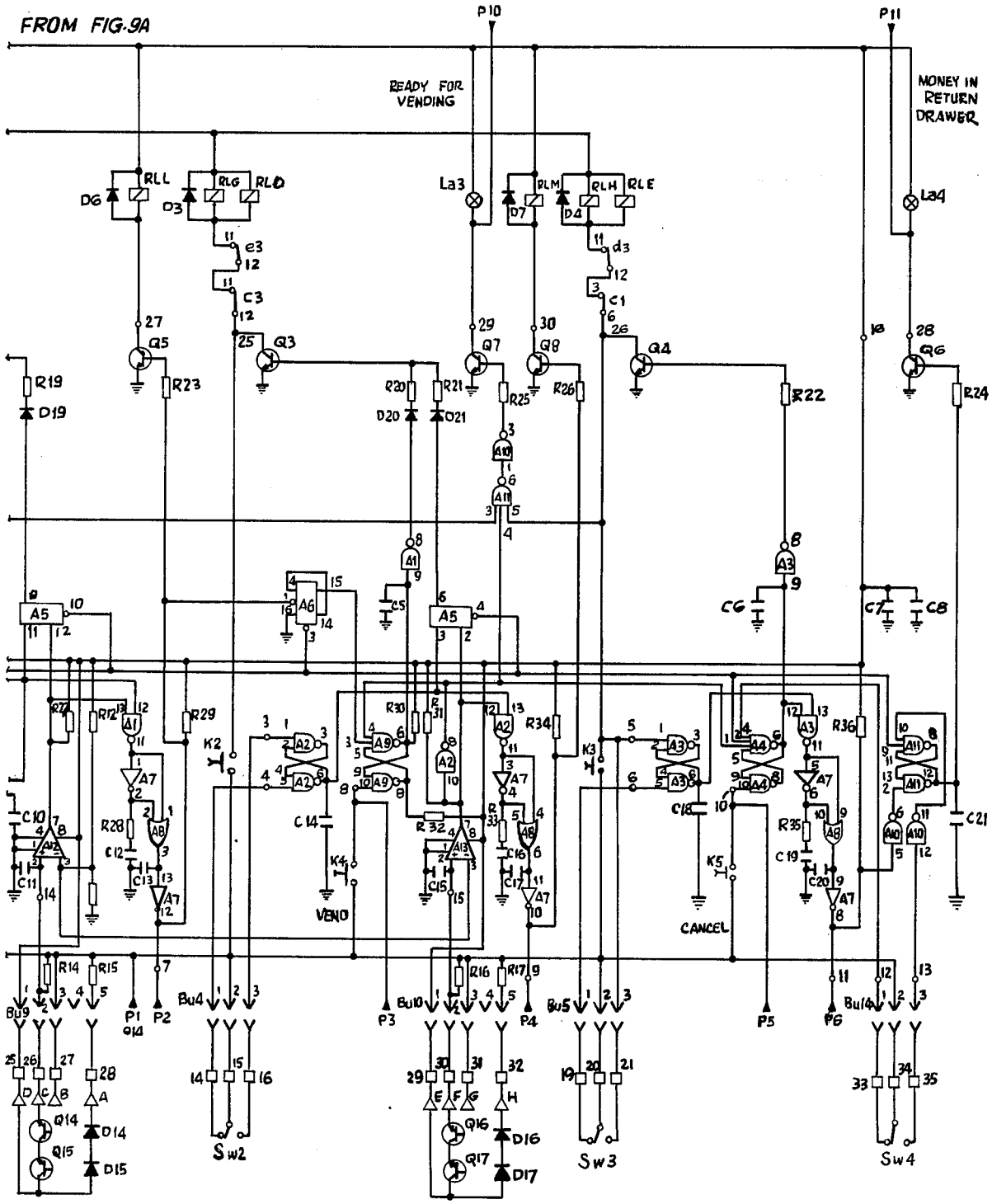
Figure 10:
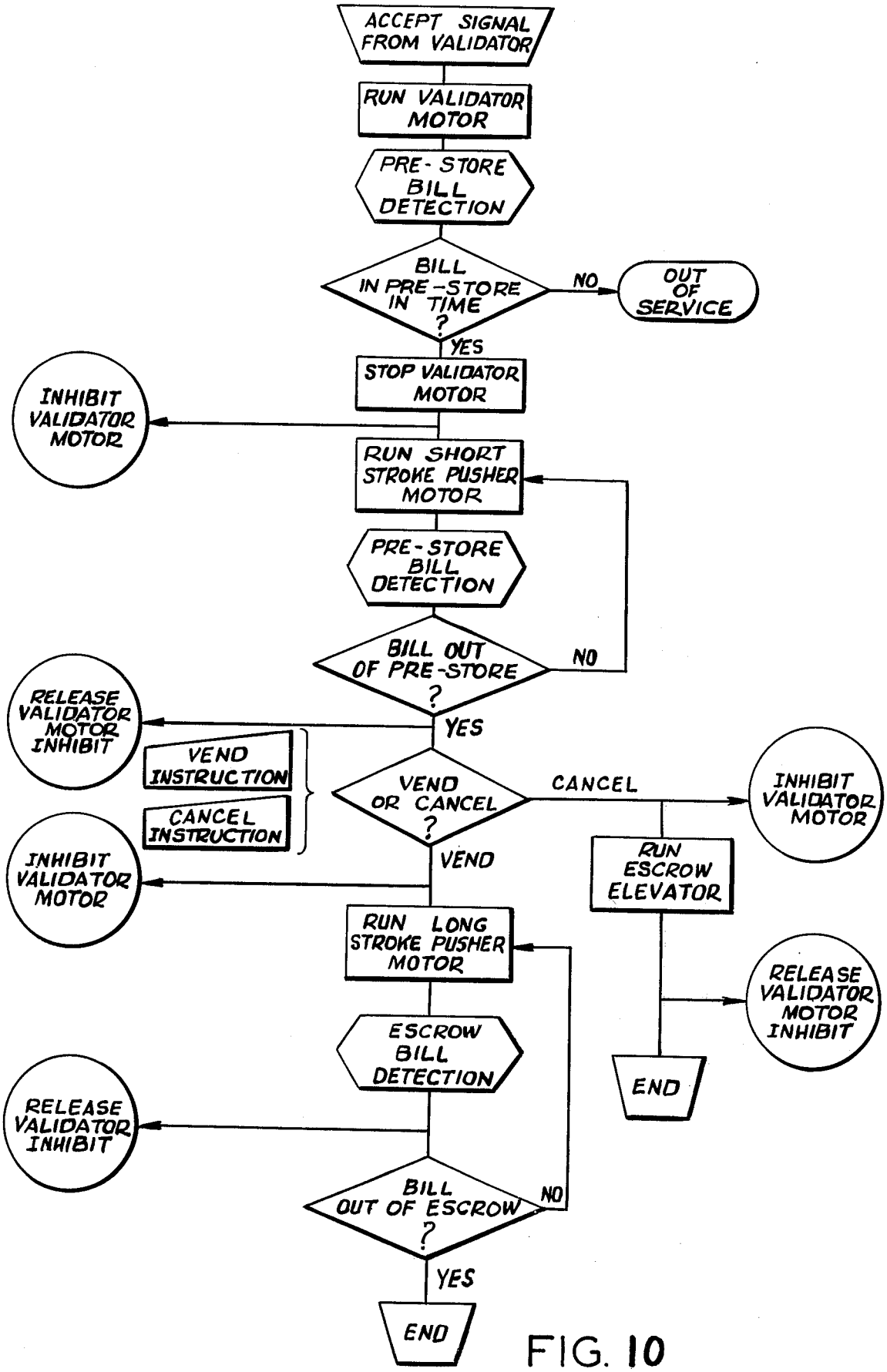
Figure 11:
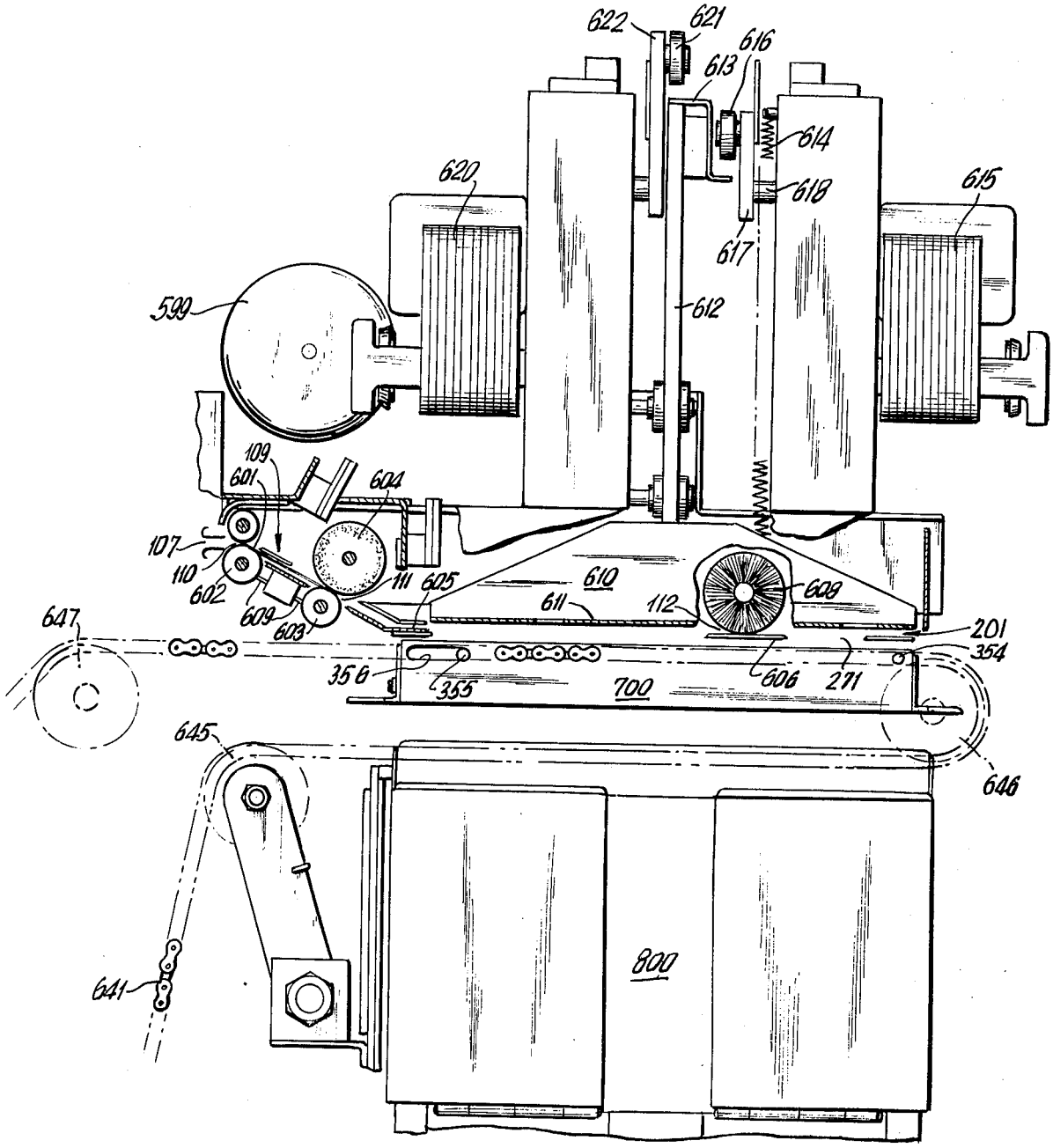
Figure 12:
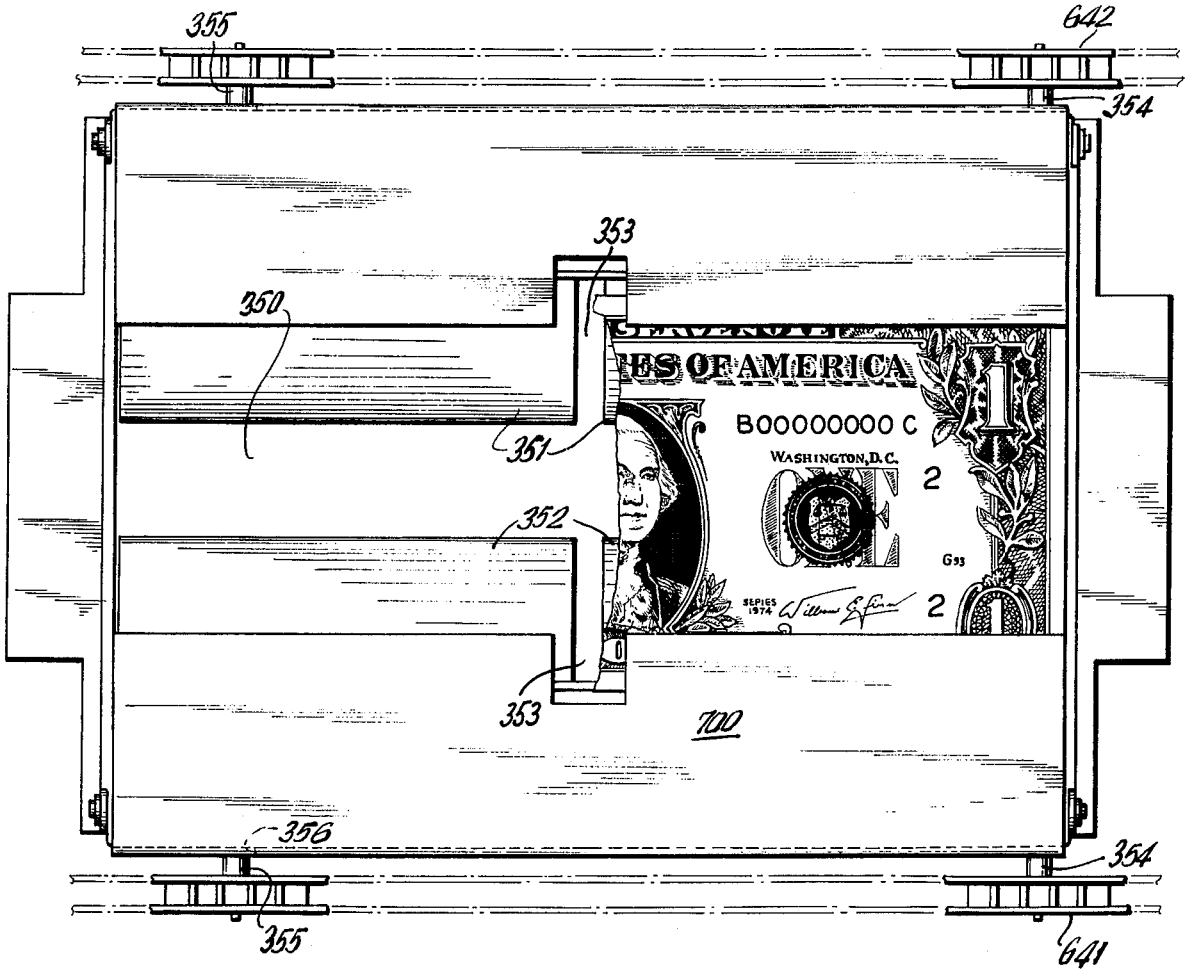
Figure 13:
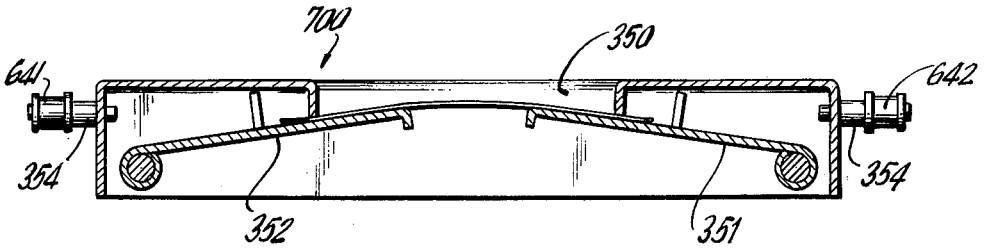
Figure 14:
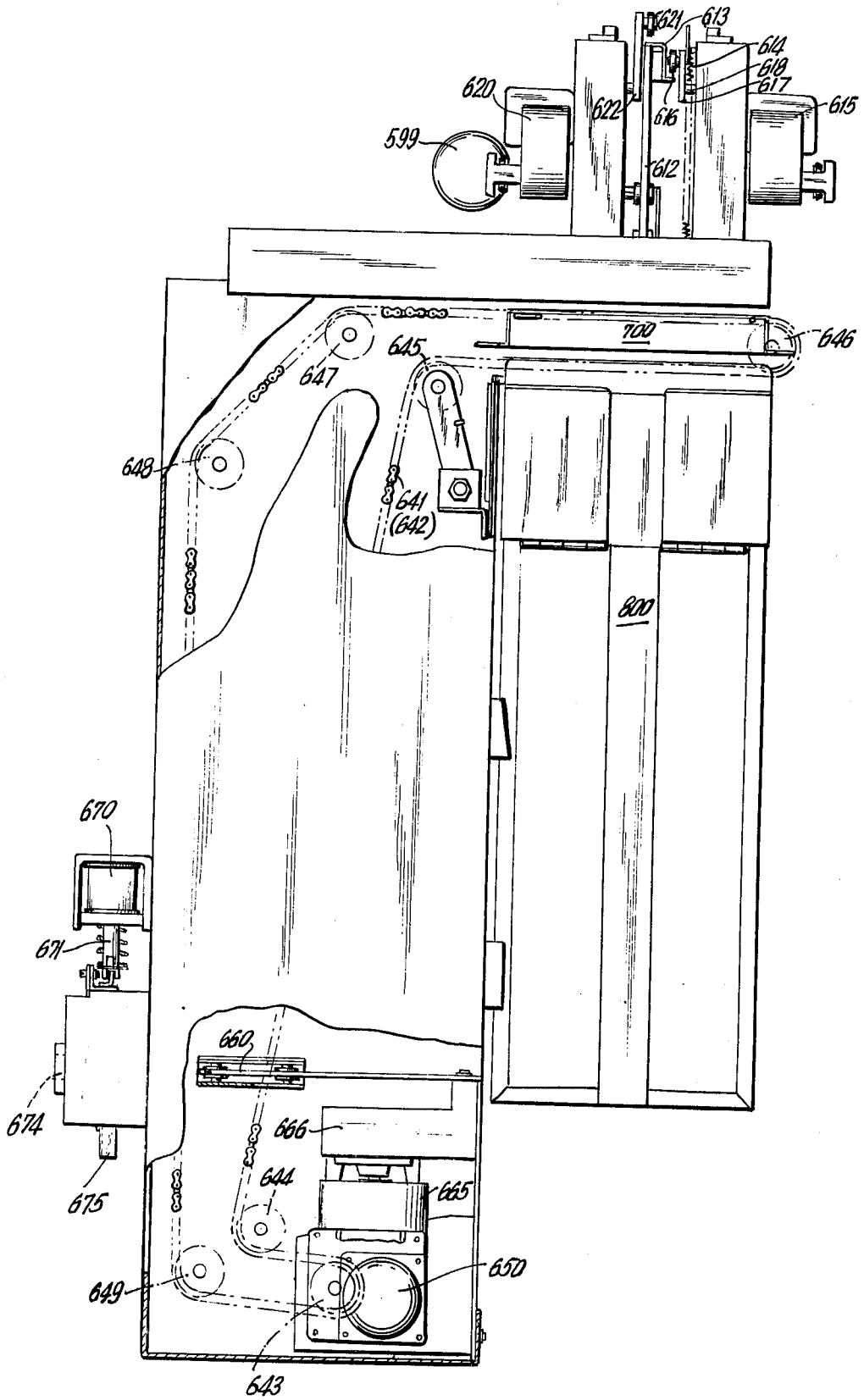
Figure 15:
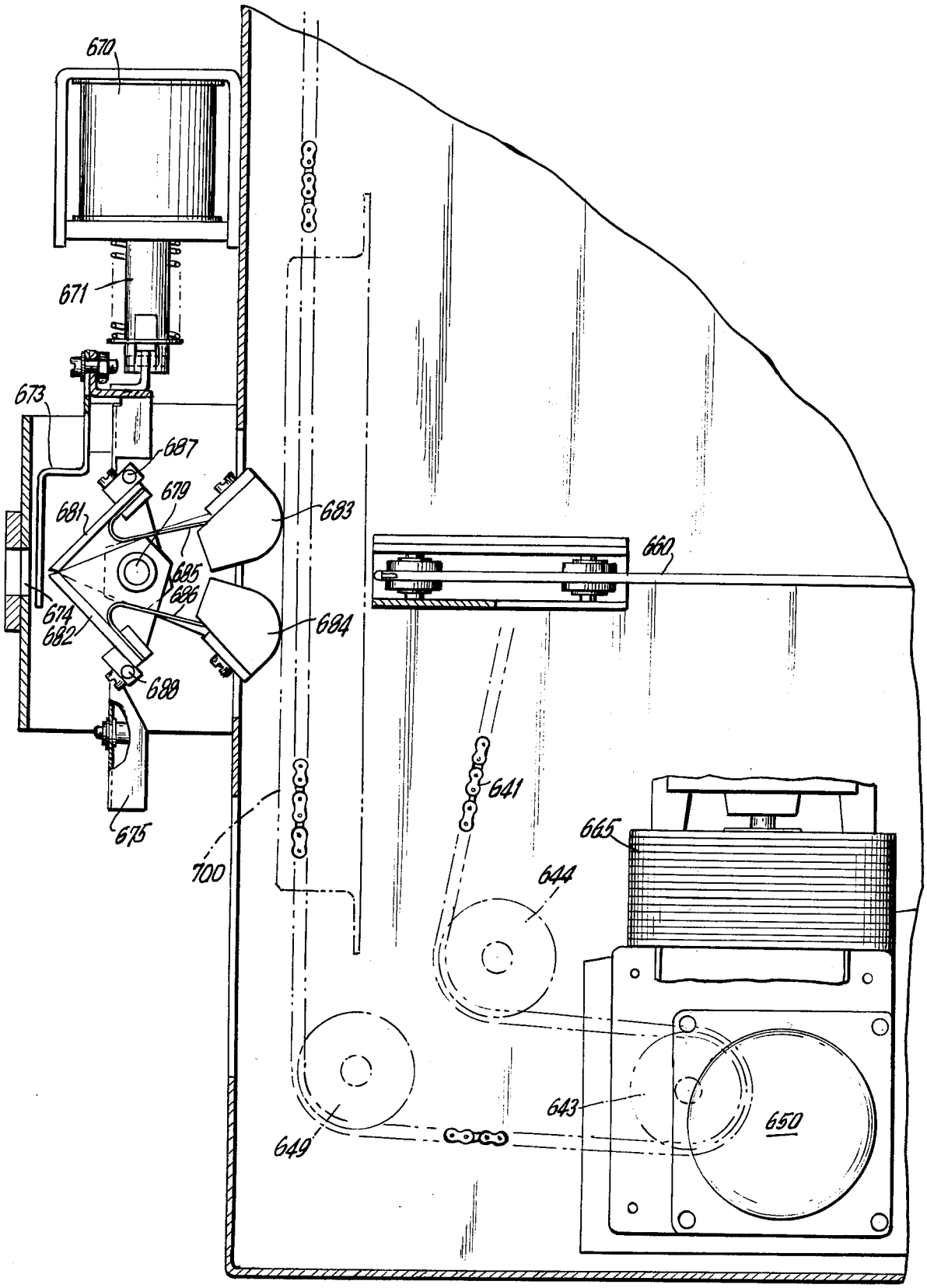

In the drawings:

FIG. 1 is a perspective view partially broken away of an apparatus according to the present invention, FIG. 2 is an elevational view of the front of the apparatus of FIG. 1, FIG. 3 is an elevational view of the side of the apparatus of FIG. 1, FIG. 4 is a top view of the apparatus of FIG. 1, FIG. 5 is a bottom view of the lowermost portion of the apparatus of FIG. 1, FIG. 6 is an elevational view of the rear of the apparatus of FIG. 1, FIG. 7 is a detail view from the rear of the pre-storage compartment of the apparatus of FIG. 1, FIG. 8 is a detail view in perspective of the rear of the escrow compartment of the apparatus of FIG. 1, FIGS. 9A and 9B are the schematic diagram in two parts of a suitable circuit for the apparatus of FIG. 1, FIG. 10 is a flow chart showing the sequence of operation of the apparatus of FIG. 1, FIG. 11 is a side elevational view partially broken away of a portion of a second embodiment of the present invention, FIG. 12 is a top view of the escrow compartment of the second embodiment, FIG. 13 is a rear cut-away view of the escrow compartment, FIG. 14 is a side elevational view of the second embodiment, and FIG. 15 is a side elevational view partially broken away of the refund portion of the second embodiment.

A banknote handling machine constructed in accordance with the present invention incorporates several main component groups: the banknote receiving means and the pre-storage location or compartment 200, the escrow compartment of container 300, the deposit container or box 400, the refund system 500, and the control circuitry 700; each of which will be described below. The validator 100 is not a part of this invention.

The validator 100 employed in the embodiment illustrated and described herein in FIGS. 1-9 is a commercially available unit sold by National Rejectors, Inc., (NRI), St. Louis, Mo. U.S.A. as type 34.04.005, modified as described below. This validator accepts a banknote, narrow edge first, in a horizontal attitude at the banknote entrance 102 and transports the banknote lengthwise within the validator housing 104 past a group of sensors, such as magnetic read heads, which are arranged to scan predetermined portions of the banknote to read information magnetically encoded in the banknote to ascertain its validity and denomination. The output signals of the sensors are processed by logic circuits in the validator to determine whether the banknote is acceptable. The banknote is delivered from the bottom of the validator 100 in a vertical attitude through a banknote exit 106. The validator provides an electrical signal output signifying the acceptability of the banknote. A banknote unacceptable to the validator is ejected back through the banknote entrance by reversal of the validator transport mechanism. The validator transport mechanism is run for a time sufficient to fully deliver the banknote from the validator exit 106. Since the validator is a commercially available unit which itself is not the subject of the present invention, further detailed description is unnecessary.

Some minor modifications have been made to the NRI validator to make it more compatible with the remainder of this embodiment of the banknote handling machine described herein. A shaped banknote exit 106 has been substituted, to curve the banknote slightly to make the banknote stiffer along its length. The predetermined validator motor running time has been increased to assure the complete delivery of a banknote to the pre-storage compartment. The motor drive shaft 108 has been extended outside the validator for use in synchronously driving the transport mechanism of the pre-storage compartment with that of the validator. Finally, an electrical connector access 111 to validator bill detection and motor circuits has been provided to connect them to the control circuitry of the banknote handling machine.

A validator other than the NRI 34.04.005 can be used with apparatus according to the present invention, the requirements being that it adequately validate the banknotes with which it is to be used and that it can be arranged to deliver banknotes to the apparatus of the present invention.

The pre-storage location or compartment 200 receives the banknote in a vertical attitude as it is delivered narrow edge first downwardly from the banknote exit of the validator 100. A banknote guide 202 connects the pre-storage compartment with the validator banknote exit. The banknote guide 202 is shaped in conformance with the validator banknote exit 106 to retain the curve in the banknote which stiffens the banknote.

The pre-storage compartment 200 is a box formed by fixed sidewalls 204, a bottom wall 208, an inner wall which has a rectangular central aperture or window 270 defined by marginal edges 272 of the sidewall (see FIG. 7) slightly narrower in its minor axis than the minor axis of a flat banknote and at least as high as the length of a banknote, and a movable outer wall formed by a movable banknote pusher mechanism 210. The pre-storage compartment is intended to accommodate only a single banknote. A banknote transport mechanism in the form of driven rollers frictionally propels the banknote downwardly into the pre-storage compartment from the validator. The banknote transport includes upper rubber rollers 212 and soft lower rollers 214 of foam plastic, foam rubber or bristles. The linear speed of the banknote transport is greater than the speed at which the banknote is delivered by the validator transport mechanism and the linear speed of the lower foam or bristle rollers 214 of the banknote transport is higher than that of the upper rollers 212 to tension the banknote lengthwise to insure that the banknote is straight as it comes to rest in a fixed position in the pre-storage compartment. The banknote transport mechanism rollers 212, 214 are driven through belts 216 and 218 from an extended shaft 108 of the validator transport mechanism motor to synchronize the validator and the banknote transport and to fix the difference in linear speed between the banknote transport rollers.

The banknote and validator transport mechanisms are timed by the control circuit to run for a fixed time, in the order of one second, after the accept signal is generated by the validator. After lapse of the fixed time, the transport mechanisms stop. The pre-storage compartment 200 contains a banknote presence detector device which consists of infrared light emitting diodes (LED) (D14 and D15) and photo-transistors (Q14 and Q15) used in a light reflective mode. The light beam of the LED is reflected from a chromium plated surface of the pre-storage compartment to the photo-transistor. When a banknote is properly stored in a predetermined fixed position, little of the light is reflected. When no banknote is present, LED light reflection from the reflective surface saturates the photo-transistor. If the banknote detector senses a banknote properly stored in the fixed position within the fixed time of the banknote transport run cycle, normal operation is continued. If no banknote is detected or the banknote is not in the fixed position, light reflected from the surface of the compartment saturates the photo-transistor. If the photo-transistor is saturated within the fixed transport run time following the accept signal, the transaction does not go forward and an "out of order" indicator lights.

The escrow compartment or container 300 has as its primary function the accumulation of banknotes until a sufficient value is reached for the contemplated transaction. Banknotes which have been accepted by the validator 100 and delivered to the pre-storage compartment 200 are transferred to the escrow compartment 300 for temporary storage until the customer elects to either complete or cancel the transaction.

The escrow compartment 300 is a vertically movable cage having side 302 and bottom wall 304 and an inner wall in the form of a pair of swinging doors 310 (see FIGS. 6 and 8). The outer wall of the escrow compartment includes a window (not shown) which aligns with the window 270 of the inner wall of the pre-storage compartment 200. The escrow window is similar to the pre-storage compartment window in dimensions.

The short stroke of a banknote pusher 210 moves a banknote from the pre-storage compartment 200 through the aligned pre-storage and escrow windows and against the closed swinging doors 310. The banknote and previously delivered banknotes are retained in the escrow in a stack by entrapment between the frame or margin of the escrow window and the closed swinging doors 310. The swinging doors 310 pivot through approximately a right angle to open and are biased closed by springs (not shown). The hinge rods 312 about which the doors swing are vertical and are associated with the side walls 302 of the escrow compartment by guide pins 314 which are free to move horizontally in slots 316 in the side walls. The pins 314 are biased by springs 318 to urge the closed doors outwardly toward the escrow window. Thus, the closed doors can be displaced from the escrow window against the spring bias as banknotes are delivered from the pre-storage compartment. A stack of approximately 25 banknotes can be accommodated in the escrow compartment.

A banknote properly stored in the pre-storage compartment within the fixed time of the pre-storage transport run cycle is then moved facially from the pre-storage compartment 200 through the window 270 of the inner wall into the escrow compartment 300. The movable outer wall of the pre-storage is the pusher member 210 which is advanced forward to push the banknote facially through the window 270 of the inner wall and into the escrow compartment 300. The pusher, which is best shown in FIGS. 7 and 8, comprises a central vertical bar 220 and a pair of pivoted shoe members 222 and 224. The face of the pusher assembly is approximately the size of the banknote. The central vertical bar 220 is narrower than the banknote and resides in a channel in the shoe members. The shoe members extend on either side of the bar to approximate the width of the banknote. The shoe member 222, 224 are each connected to the sides of the bar with pivots 226, 228 near the middle of the height of the bar 220. The other ends of the shoe members are retained by pins or rollers in vertical channels or tracks (not shown) in the sidewalls of the escrow compartment 300. As the pusher 210 is first moved to transfer a banknote from the pre-storage compartment to the escrow compartment, the bar 220 comes forward bringing with it the shoe members 222, 224, all as a flat plane. As the pusher 210 is farther moved to transfer a banknote from the escrow compartment to storage, the bar 220 comes forward bringing with it the pivotally attached ends of the shoe members 222, 224. The other ends of the shoe members do not move forward since they are retained in the track. The shoe members pivot and slope back from the bar. FIG. 7 is a detail view showing the banknote pusher assembly 210 in the retracted position and FIG. 8 is a detail view in perspective showing the pusher in an advanced position with the shoe members 222, 224 sloping back from the bar 220.

The push assembly 210 with the shoe members 222, 224 and bar 220 moving as a flat plane is used to move a banknote from the fixed position in the pre-storage compartment 200 into the escrow compartment 300. The pusher assembly 210 with the shoe members 222, 224 sloping back from the pivotal attachment of their ends to the bar is also used later in the cycle of the machine when it is instructed to move the stack of banknotes accumulated in the escrow compartment 300 into the deposit box 400. These two functions of the pusher require strokes of different lengths. The movement of a banknote into the escrow compartment requires a stroke of about 35 mm. and the movement of accumulated banknotes from the escrow compartment into the deposit box 400 requires a stroke of about 65 mm. The two stroke lengths are provided by separate driving mechanisms or actuators which comprise motors 240 and 242 and linkages 250 and 260. Motor 240 and linkage 250 provide the short 35 mm. stroke of the pusher to move the banknote from the pre-storage compartment to the escrow compartment. Motor 242 and linkage 260 provide the long 65 mm. stroke to move the stack of banknotes from escrow into the deposit box.

The escrow compartment 300 also constitutes an elevator cage which can be moved vertically to transfer the banknotes retained in the escrow compartment to a refund bin 510 located below the banknote entrance to the validator. The escrow compartment 300 is supported by elevator columns 320, 322 which are provided with double helix threads engaged by nut members 340, 342 affixed to the escrow compartment. The threaded elevator columns are rotated by a motor 330 and an appropriate drive train 332, 334, 336. One thread groove 324 of the columns causes the escrow compartment to descend upon rotation of the elevator columns. Upon reaching the bottom of the vertical travel of the thread the nut members 340, 342 intercept a transfer groove which shifts the nut members to the other thread 326 of the double helix. This second thread 326 is opposite in pitch to the first thread 324 to cause the escrow compartment to return by ascending. A similar transfer groove at the top of the columns shifts the nut members back to the first thread. Thus, rotation of the elevator columns in one direction causes the escrow compartment to descend, pause at the bottom, ascend, and pause at the top while the motor continues to run in but one direction.

The elevator action of the escrow compartment 300 is employed upon the command of a customer who elects to cancel a transaction rather than to complete it. If the customer elects to proceed with the transaction and has entered banknotes of sufficient value into the banknote entrance of the validator 100, the control circuitry will complete the transaction upon a vend command. The pusher 210 will be advanced by the drive motor 242 and its associated linkage 260 to provide the longer (65 mm.) of the two available stroke lengths of the pusher. The pusher advances through the pre-storage and escrow windows to push the banknotes retained in the escrow compartment against the swinging doors 310 to cause the doors to pivot about their hinge pins to open inwardly. The banknotes are pushed through the open doors into the deposit box 400. The escrow compartment 300 includes a bill detector comprising LED's (D16 and D17) and the photo-transistors (Q16 and Q17) arranged in a manner similar to that of the pre-storage compartment to provide a signal indicating the presence or absence of banknotes in the escrow compartment to the control circuit. At the completion of the transfer of banknotes from the escrow compartment to the deposit box 400, the control circuit energizes the vend mechanism of the vending machine with which the subject banknote handling machine is associated to vend the goods or perform the function of the transaction.

The deposit box 400 is a semi-permanent banknote storage compartment in the form of a deep rectangular container of a size to accept vertically oriented, facially stacked banknotes. A movable interior rear wall 410 is biased outwardly by a spring 412 to urge the stored banknotes forwardly against the front wall to keep the stack of banknotes orderly. The front wall of the deposit box includes a window similar to those of the pre-storage and escrow compartments, that is, an aperture slightly narrower than the width of a banknote and at least as high as the length of a banknote. The spring loaded movable wall 410 compresses the stack of stored banknotes against the frame or margin of the deposit box window. Except for the window, the deposit box is sealed. A closure assembly 420 for the window is biased toward closure by a spring mechanism 422 to cause the deposit box window to automatically be closed and latched when the deposit box is removed from the machine, to prevent access to the contents of the deposit box. To collect stored banknotes, the deposit box is ordinarily replaced with an empty deposit box and opened at a central location by authorized personnel with an appropriate key, to remove the stored banknotes. The machine serviceman ordinarily would not be able to unlock and open the deposit box.

If the customer elects to cancel a transaction and obtain a return of his banknotes, his instruction causes the escrow elevator to operate to lower the escrow compartment 300 and then raise it. When the escrow is at its lower position, the banknotes in the escrow compartment are extracted by a clamp mechanism 522, 524, 526, 528 in the refund bin 510 which frictionally holds the banknotes as the escrow compartment is raised again. The refund bin door 512 permits the customer to remove the banknotes from the clamp mechanism. The clamp mechanism comprises a pair of opposed fingers 522, 524 actuated by a cam follower 526 which rides on a configured cam 528 geared to the elevator column drive motor 330 to open and close the fingers to receive and grip the banknotes as the escrow compartment cycles down and up.

The banknote handling machine of the present invention is supported from a front panel 600 which becomes a part of the vending machine cabinet exterior. The front panel includes the banknote entrance 102 for the validator and the refund bin door 512. Since the front panel 600 is normally mounted on the hinged front wall of the vending machine, the banknote handling machine of the present invention is conveniently accessible for servicing, cleaning and maintenance.

The control circuitry provides and processes signals which reflect such information as the presence or absence of a banknote in the pre-storage 200 and escrow 300 compartments, receives signals from the validator 100 indicating the acceptability of a banknote, command signals reflecting the customer's decision to cancel or to go forward with the transaction, and information from the vending machine as to the adequacy of the value of the received banknotes to the price of the selected transaction and the ability of the vending machine to deliver the desired goods or services. This control circuitry includes logic to perform the various machine operations in proper sequence and provides power to the several motors and electric actuators.

FIGS. 9A and 9B show a suitable circuit for the operation of the apparatus described above. The groups of terminals identified by numerals preceded by the letters "BU" are connected to the elements of the apparatus indicated below:

| | |
|---|---|
| BU1 | To Validator |
| BU2 | To Validator |
| BU3 | Escrow Switch, SW1 |
| BU4 | Banknote Pusher Switch, SW2 |
| BU5 | Elevator Switch, SW3 |
| BU6 | Escrow Motor, M1 |
| BU7 | Banknote Pusher Motor, M2 |
| BU8 | Elevator Motor, M3 |
| BU9 | Optical Pre-storage Sensor |
| BU10 | Optical Escrow Sensor |
| BU11 | no connection |
| BU12 | no connection |
| BU13 | Container End Switch, SW5 |
| BU14 | Refund Bin Switch, SW4 |
| BU15 | Refund Bin Locking Solenoid |
| BU16 | no connection |

The switches identified by numerals preceded by the letter "K" perform the functions indicated below:

| | |
|---|---|
| K1 | Manual Escrow Motor Control |
| K2 | Manual Banknote Pusher Motor Control |
| K3 | Manual Elevator Motor Control |
| K4 | Manual Vend Instruction |
| K5 | Manual Cancel Instruction |
| K6 | Out Of Service Reset |

The relays identified by letters following the letters "RL" are of the type indicated below:

| | |
|---|---|
| RLA | Guardian A410-363625-15 (120VAC) |
| RLB-RLE | Siemens V 23154-D0712-B110 |
| RLK-RLM | Siemens V 23154-D0712-B110 |
| RLF-RLH | Siemens V 23154-D0712-F104 |

-continued

| | |
|---|---|
| RLN | Siemens V 23154-D0712-F104 |

The lamps identified by La1 through La5 are 5 volt, 200mA incandescent lamps. The semiconductor devices identified by numerals preceded by a letter "Q" (transistor) or "D" (diode) are of the type indicated below:

| | |
|---|---|
| Q1-Q13 | BC174 |
| Q14-Q17 | BPX25 |
| D1-D12 | 1N914 |
| D13 | 10D8 |
| D14-D17 | SSL55B (LED) |
| D18-D24 | 1N914 |

The integrated circuit semiconductor devices identified by numerals preceded by the letter "A" are of the type indicated below:

| | |
|---|---|
| A1-A4 | SN7400 |
| A5 | SN7474 |
| A6 | SN7476 |
| A7 | SN7406 |
| A8 | SN7432 |
| A9 | SN7412 |
| A10 | SN7400 |
| A11 | SN7410 |
| A12 | LM311 |
| A13 | LM311 |

The resistors identified by numerals preceded by the letter "R" have the following values in Ohms:

| | | | |
|---|---|---|---|
| R1 | 4700 | R20 | 470 |
| R2 | 470 | R21 | 470 |
| R3 | 470 | R22 | 470 |
| R4 | 470 | R23 | 1000 |
| R5 | 470 | R24 | 470 |
| R6 | 150,000 | R25 | 470 |
| R7 | 10,000 | R26 | 1000 |
| R8 | 10,000 | R27 | 1000 |
| R9 | 150,000 | R28 | 100 |
| R10 | 5100 | R29 | 150 |
| R11 | 2700 | R30 | 3900 |
| R12 | 2000 | R31 | 1000 |
| R13 | 2000 | R32 | 3900 |
| R14 | 47,000 | R33 | 100 |
| R15 | 39 | R34 | 150 |
| R16 | 47,000 | R35 | 100 |
| R17 | 39 | R36 | 150 |
| R18 | 470 | R37 | 100 |
| R19 | 470 | R38 | 100 |

The capacitors identified by numerals preceded by the letter "C" have the following values in micro-Farads:

| | |
|---|---|
| C1 | 47 |
| C2 | 100 |
| C3 | 10 |
| C4 | 33 |
| C5 | 0.05 |
| C6 | 0.05 |
| C7 | 10 |
| C8 | 0.1 |
| C9 | 47 |
| C10 | 0.01 |
| C11 | 0.05 |
| C12 | 100 |
| C13 | 0.01 |
| C14 | 0.01 |
| C15 | 0.05 |
| C16 | 100 |
| C17 | 0.01 |
| C18 | 0.01 |
| C19 | 100 |
| C20 | 0.01 |
| C21 | 0.01 |

The contacts of the output plug, an Amphenol type 57-40140 plug, are identified by numerals preceded by the letter "P". The functions of these contacts are as follows:

| | |
|---|---|
| P1 | Ground |
| P2 | Accumulate Signal, Positive Going Output Pulse, 150 ms. |
| P3 | Vend Instruction Input, Ground Condition |
| P4 | Vend Signal, Positive Going Output Pulse, 150 ms. |
| P5 | Cancel Instruction Input, Ground Condition |
| P6 | Cancel Signal, Positive Going Output Pulse, 150 ms. |

With the preceding information, the operation of the circuit of FIGS. 9A and 9B should be clear to those skilled in the art. Since the use of this circuit is not essential to the accomplishment of the present invention, it will not be described further.

FIG. 10 is a flow diagram of the operation of the banknote handling machine of the present invention which indicates the functions of the control circuitry. The sequence of events diagrammed in FIG. 9 begins with an accept signal from the validator 100 which indicates that an acceptable banknote has been received and processed by the validator. The accept signal begins a timed run of the validator motor to deliver the banknote from the validator exit and to drive the banknote transport mechanism 212, 214, 216, 218. Detectors comprising LED's D14 and D15 and the associated photo-transistors Q14 and Q15 determine whether a banknote has been properly transported into the pre-storage compartment. If the photo-transistors are not darkened within the fixed run time of the validator motor, an out of service signal lights an indicator and prevents completion of the transaction.

If the pre-storage photo-transistors are darkened on schedule, a signal starts the short (35 mm.) stroke pusher motor 240 to transfer the banknote from the pre-storage compartment 200 to the escrow compartment 300. Simultaneously, the validator motor is inhibited to prevent the receipt into the pre-storage compartment 200 of a second banknote. The short stroke pusher motor runs for one complete cycle of the pusher 210 until the pusher is returned to its initial position. The transfer of the banknote from the pre-storage compartment 200 is determined by the pre-storage banknote detector comprising LED's D14 and D15 and photo-transistors Q14 and Q15. If the sensors remain darkened, indicating a failure to transfer the banknote, the short stroke pusher motor 240 repeats its cycle. When the pre-storage banknote detector indicates the absence of a banknote, the validator motor inhibit signal is terminated and the machine indicates that it is prepared to vend and waits for the customer's instruction.

If a cancel instruction is issued by the customer pushing a cancel button, the escrow elevator motor 330 is run for a complete cycle of lowering and raising the escrow compartment to remove any banknote or banknotes from the escrow and deposit them in the refund bin 510 for retrieval by the customer.

When a vend instruction is issued by the customer pushing a selected vend button, the long (65 mm.) stroke pusher motor 242 is run for a complete cycle of the pusher 210 to push the banknotes from the escrow compartment 300 into the deposit box 400 and return the pusher 210 to its initial position. During the cycle of pusher operation the validator motor is inhibited to prevent receipt of further banknotes. A signal from the escrow banknote detector comprising LED's D16 and D17 and phototransistors Q16 and Q17 indicates whether the escrow compartment is empty. If not, the pusher 210 is cycled through a long stroke again. When the escrow detector indicates that the banknotes have been transferred from escrow 300 to the deposit box 400, the transaction is completed by signaling the vending machine to vend the selected goods or to perform the service. The validator motor inhibit signal is then terminated, to permit receipt of banknotes for the next transaction.

Another embodiment of a banknote handling machine constructed in accordance with the present invention is illustrated in FIGS. 11–15. This embodiment, while having the same main component groups as the embodiment illustrated in FIGS. 1–9, differs from it in some details.

The validator employed in the embodiment illustrated in FIGS. 11–15 is a commercially available NRI unit, type 04.74.903. This unit operates in a similar manner to the type described in connection with the previous embodiment, except that it delivers the banknote from the rear in a horizontal attitude through exit 107.

A banknote delivered from the validator is transported edge first through an inclined neck 109 to a pre-storage compartment 201 by three sets of driving means. As shown in FIG. 11, the leading edge of the banknote is first engaged in a nip 110 formed in the neck between two rubber belts 601 above and two Delrin rollers 602 below. Belts 601, which are located approximately 1 centimeter to either side of the centerline of the banknote path, are driven externally by motor 599 through a belt drive system (not shown), and rollers 602 are urged against belts 601 by springs 609. To tension the banknote lengthwise, the velocity of the belts is set so that the velocity of the banknote when under control of the belts is greater than the transport velocity of the banknote out of the validator. In one example of this embodiment the validator output velocity is 16 meters/-minute and the driving velocity of the belts is about 30 meters/minute. The banknote speed is thereby increased by about 10 percent, to about 18 meters/minute.

A few centimeters further along the neck the banknote is engaged by a second nip 111. The upper portion of this second nip 111 is formed by belts 601 and two rubber wheels 604 located about 3 centimeters to either side of the centerline of the banknote path on the same axis as the belt support wheels. The lower portion of the nip 111 comprises four coaxial Delrin wheels 603 identical in size to wheels 602. Each Delrin wheel 603 is opposed to and urged against one of the belts 601 or rubber wheels 604.

After passing the second nip 111, the banknote is deflected to a horizontal direction by the lower wall 605 of the neck. Further motion in the horizontal direction brings the banknote into the pre-storage compartment 201, beneath pusher 610. As it moves horizontally into the pre-storage compartment 201, the banknote is supported along both side edges by shelves 606 which extend about 1 centimeter in toward the centerline of the banknote. The window 271 in the bottom of the pre-storage compartment 201 is open except for the side shelves 606, and the length of the pre-storage compartment 201 is slightly greater than the average length of a banknote. As in the pre-storage compartment 200 of the preceding embodiment, the pre-storage compartment 201 in this embodiment is intended to accomodate only a single banknote. When approximately ⅔ of the banknote has entered the pre-storage compartment 201, propelled by the rollers and belts at the first and second nips, and then just the second nip of the neck 109, the leading edge of the banknote enters a third nip 112, formed by two coaxial driven brushes 608 and shelves 606. Brushes 608 in the example described here have a driving velocity of about 60 meters/minute, and therefore the banknote is again tensioned, and its speed increased by about 10 percent, as it completes its entry into the pre-storage compartment.

As in the preceding embodiment, the progress of the banknote through the neck 109 and into the pre-storage compartment 201 is monitored by a plurality of light emitting diodes and photo-transistors used in a light reflective mode. Also as in the preceding embodiment, the banknote and validator transport mechanisms are timed by the control circuit which is suitably connected to the photo-transistors as described above.

As soon as the banknote has entered the pre-storage compartment 201, a pusher assembly 610 is activated for its short stroke by motor 615 and forces the banknote down toward the escrow compartment 700. In this embodiment pusher assembly 610 comprises a horizontally oriented rectangular plate 611, an upstanding bar 612 attached to the rear of the plate, and a Z-shaped member 613 mounted atop the bar and adapted to be engaged by rollers 616 and 621 which are eccentrically connected respectively to pusher motors 615 and 620 by arms 617 and 622. When motor 615 is activated, arm 617 rotates about shaft 618 at an angular velocity determined by the gear assembly located between that shaft and the motor. As arm 617 rotates, roller 616 will begin to bear on the adjacent branch of member 613 and thereby cause the pusher assembly to move downward, against the upward bias of tension spring 614. Plate 611 has a length 3–5 millimeters less than the average length of a banknote and a width equal to about ⅔ the average width of a banknote. Downward movement of plate 611 bows the banknote downward through the window 271, eventually causing the edges of the banknote to slide off shelves 606. Further movement of plate 611 inserts the banknote in escrow compartment 700, located beneath the pre-storage compartment, in a manner to be described.

Escrow compartment 700 in this embodiment, best illustrated in FIGS. 11, 12 and 13, is essentially similar to the escrow compartment 300 of the preceding embodiment except that it receives banknotes in a horizontal rather than a vertical orientation. Its function is the same as in the previous embodiment. The top of escrow compartment 700 has a window 350 of the same dimensions as the window 271 in the bottom of the pre-storage compartment 201. When bills are being inserted into the machine the escrow compartment 700 is positioned so that its window 350 is aligned with the window 271 of the pre-storage compartment 201. The bottom of the escrow compartment 700 is composed of a pair of swinging doors 351 and 352 mounted along the sides of the compartment and spring-biased upward to the horizontal, normally closed position. In this position the doors 351 and 352 underlie and support the facially stacked banknotes that have been delivered from the pre-storage compartment 201. The closed doors 351 and 352 can be rotated downward away from the escrow window through approximately a right angle against the spring bias by the plate 611 of the pusher as it delivers banknotes from the pre-storage compartment.

As in the preceding embodiment, escrow compartment 700 accumulates banknotes accepted by the validator until a sufficient value is reached for the contemplated transaction and the customer elects to proceed or to cancel the transaction. If the customer instructs the machine to complete the transaction, the pusher assembly 610 is activated for its long stroke by motor 620 to force the banknotes retained in the escrow compartment facially downward against swinging doors 351 and 352, which open under the pressure generated, and into the deposit box 800 (FIG. 14) beneath. The opened doors act as guides for the banknotes entering the deposit box, insuring that they stack properly in the box. The deposit box in this embodiment is essentially similar to that in the preceding embodiment except that here the box receives banknotes from above.

As best appears in FIG. 14, the escrow compartment 700 in this embodiment is mounted between two parallel movable chains 641 and 642. Chain 641 is driven by a reversible motor 650 connected to drive sprocket 643. In this embodiment chain 642, not visible in FIG. 14 because located directly behind chain 641, is not connected to the motor but follows essentially the same path as chain 641, on the other side of escrow compartment 700. Each chain passes over one part of sprocket pairs 644, 645, 646, 647, 648 and 649 and is connected to escrow compartment 700 near its trailing edge by a fixed pin 354 and near its leading edge by a pin 355 which is free to move in a slot 356 in the side of the escrow compartment.

If the customer instructs the machine to return all escrowed banknotes, the motor 650 is activated in its forward direction, causing the escrow compartment to move first toward the front of the machine and then downward to a refund position about 50 centimeters below the banknote entrance. As the escrow compartment 700 changes direction, that is between the time leading pins 355 pass sprocket pair 647 and the time trailing pins 354 pass sprocket pair 648, pins 355 slide within slots 356. This movement of pins 355 enables the rigid body of escrow compartment 700 to remain attached to flexible chains 641 and 642 as the compartment changes direction.

As the escrow compartment 700 approaches the refund position at the lowermost point of the vertical travel, solenoid 670 is actuated. Details of the refund position appear in FIG. 15.

Attached to the solenoid armature 671, by way of member 675, are elements of pincer mechanism used to gently but firmly hold a folded bundle of returned banknotes in position in the return slot. The pincer mechanism comprises two scraper plates 681 and 682 pivoted on shaft 679, and two Teflon clamps 683 and 684 respectively connected to plates 681 and 682 by leaf springs 685 and 686. Shaft 679 is rigidly attached to the frame of the device. Plates 681 and 682 are also attached respectively to bars 687 and 688 which ride in beveled slots of member 675. In the preferred embodiment, bars 687 and 688 are connected together by tension springs (not shown).

Actuation of solenoid 670 produces several results. First, solenoid actuation lifts the protective shield 673, rigidly attached to armature 671, out of alignment with the return slot 674. Simultaneously, the rising of member 675 forces bars 687 and 688 to move to the right in FIG. 15 and their attached scraper plates 681 and 682 to rotate around shaft 679 respectively in a clockwise (plate 681) and counterclockwise (plate 682) direction, thus opening a passage to the return slot from the positioned escrow compartment. Clamps 683 and 684 also move somewhat to the right.

At the same time, a horizontally oriented rubber-tipped knife blade 660, having a width approximately equal to the width of a banknote, is driven by motor 665 to the left. The knife blade 660 passes through the slots 353 in the now vertically oriented doors 351 and 352, and, engaging the banknotes along their width or short axis, folds then into a bundle along that axis and pushes them toward the return slot. Clamps 683 and 684 tend to squeeze the bundle of notes, but the movement of knife blade 660 pushes the mid-point of the bundle out of the return slot and into reach of the customer. The knife blade 660 then reverses direction and gradually retracts back to the ready position shown in FIG. 15, behind the path of travel of the escrow compartment. Scraper plates 681 and 682 gently grip the bills in the return slot so that they will not be retracted by the returning knife or blown away by wind.

Once the knife blade 660 has returned to its ready position, solenoid 670 is de-energized, permitting the shield 673 to drop back into place behind return slot 674 and permitting plates 681 and 682 to be drawn together by the connecting tension springs. Also, escrow compartment 700 is returned to its normal position beneath the pre-storage compartment 270 by motor 650, operating in the reverse direction.

We claim:

1. A banknote handling apparatus having a first container which is movable within the apparatus between a first position and a second position, the container having at least one opening through which banknotes can be moved, a second container having an opening for receiving banknotes from the first container, means for transporting received banknotes to a predetermined position adjacent the first position of the first container, means for transporting banknotes from the predetermined position into the first container for stacking of the banknotes in facial contact therein, means for transporting a stack of banknotes from within the first container into the second container, means for moving the first container between its first position and its second position, and refund means for removing a stack of banknotes from the first container in its second position and delivering the stack to the user of the apparatus.

2. The apparatus of claim 1 further comprising means for tensioning received banknotes while they are being transported seriatum to the predetermined position.

3. The apparatus of claim 2 further characterized by the means for tensioning and transporting a received banknote comprising a first banknote drive means arranged to facially engage a received banknote and having a driving velocity greater than the velocity of the banknote when it is first received, and a second banknote drive means arranged to receive the banknote from the first banknote drive means and facially engage it, and having a driving velocity greater than that of the first banknote drive means.

4. The apparatus of claim 3 wherein the means for transporting banknotes from the predetermined position into the first container comprise a pusher which can facially engage a banknote in the predetermined position and move it in a direction perpendicular to the banknote face into the first container.

5. The apparatus of claim 4 further characterized by a first pusher actuator having a relatively short stroke to cause the pusher to push a banknote from the predetermined location into the first container and a second pusher actuator having a relatively long stroke to cause the pusher to push the banknote stack from the first container into the second container.

6. The apparatus of claim 5 further characterized by the first container having a rectangular window on one side through which banknotes are pushed in, the minor axis of the window being narrower than the minor axis of the banknotes, and a pair of doors on the opposite side from the window which are biased closed and biased toward the window to retain the banknotes as a stack and through which the retained stack is transported by the pusher into the second container.

7. The apparatus of claim 6 characterized by the pusher comprising a central bar member and a pair of pivoted shoe members pivotally connected to the sides of the bar near the center of the bar, the other end of each of the shoe members having guide means, whereby the guide means of the shoe members are retained as the central bar member passes through the first container to transport a banknote stack from the first container to the second container.

8. The apparatus of claim 7 wherein the refund means include a pair of opposed fingers which clasps opposite surfaces of the stack of banknotes within the first container when it is in its second position.

9. The apparatus of claim 4 wherein the means for moving the first container comprise an elevator mechanism.

10. The apparatus of claim 4 wherein the first container is driven between its first and second positions by a double helix threaded screw rotating in a single direction to drive the first container first in one direction and then in the other direction.

11. The apparatus of claim 4, wherein the means for moving the first container comprises an actuator and a flexible drive chain or belt coupling the actuator to the first container.

12. The apparatus of claim 4, wherein the means for moving the first container is arranged to move the first container horizontally and then vertically in moving between its first and second positions.

13. The apparatus of claim 4 wherein the refund means comprise a return slot in the exterior wall of the apparatus, the refund slot being located in alignment with the second position of the first container, knife edge means located behind and in alignment with said return slot, and drive means for moving the knife edge in sequence through the first container in its second position, thereby engaging and folding the banknotes therein and carrying them through the return slot.

14. The apparatus of claim 13 further comprising a pair of opposed scraper plates, located adjacent the sides of the return slot and between the return slot and the second position of the first container, and means for biasing the scraper plates toward each other.

15. The apparatus of claim 1 wherein the means for transporting banknotes from the predetermined position into the first container comprise a pusher which can facially engage a banknote in the predetermined position and move it in a direction perpendicular to the banknote face into the first container.

16. The apparatus of claim 15 further characterized by a first pusher actuator having a relatively short stroke to cause the pusher to push a banknote from the predetermined location into the first container and a second pusher actuator having a relatively long stroke to cause the pusher to push the banknote stack from the first container into the second container.

17. The apparatus of claim 16 characterized by the pusher comprising a central bar member and a pair of pivoted shoe members pivotally connected to the sides of the bar near the center of the bar, the other end of each of the shoe members having guide means, whereby the guide means of the shoe members are retained as the central bar member passes through the first container to transport a banknote stack from the first container to the second container.

18. The apparatus of claim 16 further characterized by the first container having a rectangular window on one side through which banknotes are pushed in, the minor axis of the window being narrower than the minor axis of the banknotes, and a pair of doors on the opposite side from the window which are biased closed and biased toward the window to retain the banknotes as a stack and through which the retained stack is transported by the pusher into the second container.

19. The apparatus of claim 18 characterized by the pusher comprising a central bar member and a pair of pivoted shoe members pivotally connected to the sides of the bar near the center of the bar, the other end of each of the shoe members having guide means, whereby the guide means of the shoe members are retained as the central bar member passes through the first container to transport a banknote stack from the first container to the second container.

20. The apparatus of claim 19 wherein the refund means include a pair of opposed fingers which clasps opposite surfaces of the stack of banknotes within the first container when it is in its second position.

21. The apparatus of claim 15 wherein the means for moving the first container comprise an elevator mechanism.

22. The apparatus of claim 15 wherein the first container is driven between its first and second positions by a double helix threaded screw rotating in a single direction to drive the first container first in one direction and then in the other direction.

23. The apparatus of claim 15, wherein the means for moving the first container comprises an actuator and a flexible drive chain or belt coupling the actuator to the first container.

24. The apparatus of claim 15, wherein the means for moving the first container is arranged to move the first container horizontally and then vertically in moving between its first and second positions.

25. The apparatus of claim 15 wherein the refund means comprise a return slot in the exterior wall of the apparatus, the refund slot being located in alignment with the second position of the first container, knife edge means located behind and in alignment with said return slot, and drive means for moving the knife edge in sequence through the first container in its second position, thereby engaging and folding the banknotes therein and carrying them through the return slot.

26. The apparatus of claim 25 further comprising a pair of opposed scraper plates, located adjacent the sides of the return slot and between the return slot and the second position of the first container, and means for biasing the scraper plates toward each other.

27. The apparatus of claim 1 further characterized by the first container having a rectangular window on one side through which banknotes are pushed in, the minor axis of the window being narrower than the minor axis of the banknotes, and a pair of doors on the opposite side from the window which are biased closed and biased toward the window to retain the banknotes as a stack and through which the retained stack is transported by the pusher into the second container.

28. The apparatus of claim 1 wherein the refund means include a pair of opposed fingers which clasps opposite surfaces of the stack of banknotes within the first container when it is in its second position.

29. The apparatus of claim 1 wherein the means for moving the first container comprise an elevator mechanism.

30. The apparatus of claim 1 wherein the first container is driven between its first and second positions by a double helix threaded screw rotating in a single direction to drive the first container first in one direction and then in the other direction.

31. The apparatus of claim 1, wherein the means for moving the first container comprises an actuator and a flexible drive chain or belt coupling the actuator to the first container.

32. The apparatus of claim 1, wherein the means for moving the first container is arranged to move the first container horizontally and then vertically in moving between its first and second positions.

33. The apparatus of claim 1 wherein the refund means comprise a return slot in the exterior wall of the apparatus, the refund slot being located in alignment with the second position of the first container, knife edge means located behind and in alignment with said return slot, and drive means for moving the knife edge in sequence through the first container in its second position, thereby engaging and folding the banknotes therein and carrying them through the return slot.

34. The apparatus of claim 1 further comprising a a pair of opposed scraper plates, located adjacent the sides of the return slot and between the return slot and the second position of the first container, and means for biasing the scraper plates toward each other.

35. A banknote handling apparatus comprising first means to receive seriatum banknotes of like dimensions, second means to transport each received banknote edge first under tension from the first means to a substantially horizontally oriented pre-storage location;

an escrow container normally positioned in a substantially horizontal orientation beneath the pre-storage location for receiving banknotes from the pre-storage location and for holding one or more received banknotes in facially stacked relation, a deposit box positioned beneath the escrow container for receiving banknotes from the escrow container when in its normal position, and pusher means for moving each verified banknote in a direction perpendicular to the banknote face from the pre-storage location into the escrow container, the pusher means also being adapted to further move the stacked banknotes in a direction perpendicular to the banknote face down through the bottom of the escrow container and into the deposit box.

36. The apparatus of claim 35 wherein the escrow container is movable between the normal position beneath the pre-storage location and a refund position from which the banknotes contained in the escrow container may be delivered to the user.

37. The apparatus of claim 36, further comprising movable chain or belt means attached to the escrow container and connected to a drive motor, for moving the escrow container between the normal and the refund positions.

38. The apparatus of claim 37 wherein the bottom of the pre-storage compartment comprises a window having a width slightly less than the average width of a banknote and a length slightly greater than the average length of a banknote, and wherein the top of the escrow compartment, when in its normal position, comprises a window having the same dimensions as the window in the pre-storage compartment and the bottom of the escrow compartment comprises a pair of swinging doors mounted along the length of the escrow compartment and biased closed toward the window in the top of the escrow compartment to retain the banknotes in the escrow compartment as a stack and through which the retained stack is moved by the pusher means into the deposit box.

39. The apparatus of claim 36, further including a return slot located in front of and in alignment with the refund position of the escrow container, knife edge means located behind and in alignment with the return slot, and drive means responsive to the arrival of the escrow container at the refund position for moving the knife edge means in sequence through the escrow container and the return slot, thereby folding the banknotes in the escrow container into a bundle and delivering the folded banknotes through the return slot.

40. The apparatus of claim 39 further including a pair of opposed scraper plates located between the return slot and the refund position of the escrow container, for clasping the ends of the folded banknotes delivered through the return slot.

41. A method for receiving seriatum banknotes of like dimensions in a banknote handling apparatus and moving the banknotes within the apparatus to a container for facial stacking therein, characterized by a cycle having the steps of receiving each banknote, transporting the banknote edgewise to a predetermined location, pushing each banknote in a direction perpendicular to the banknote face from the predetermined location into a container, thereby facially stacking banknotes within the container, and, mechanically moving the container with facially stacked banknotes within it to a location within the apparatus where the banknotes are removed from the container and delivered to the user.

42. The method of claim 41 wherein the banknote is placed in tension during the step of transporting it edgewise to the predetermined location.

43. The method of claim 42 further characterized by the steps of twice accelerating the banknote as it is transported to the predetermined location.

44. The method of claim 41 further comprising the step of folding the banknote stack before returning it to the user.

45. The method of claim 41 further comprising the step of gripping the stack of banknotes after they are removed from the container for delivery to the user until they are removed from the apparatus by the user.

* * * * *